US005101748A

United States Patent [19]

Rohr

[11] Patent Number: 5,101,748

[45] Date of Patent: Apr. 7, 1992

[54] FEED DOG DRIVE FOR SEWING MACHINES

[75] Inventor: Gunter Rohr, Hemmingen, Fed. Rep. of Germany

[73] Assignee: Union Special G.m.b.H., Stuttgart, Fed. Rep. of Germany

[21] Appl. No.: 332,645

[22] Filed: Apr. 3, 1989

Related U.S. Application Data

[63] Continuation of Ser. No. 86,758, Aug. 18, 1987, abandoned.

[30] Foreign Application Priority Data

Aug. 29, 1986 [DE] Fed. Rep. of Germany ..... 3629514

[51] Int. Cl.[5] ..... D05B 27/00

[52] U.S. Cl. ..... 112/314; 112/324

[58] Field of Search ..... 112/313, 121.12, 307, 112/308, 314, 319, 324

[56] References Cited

U.S. PATENT DOCUMENTS

| | | | |
|---|---|---|---|
| 1,088,752 | 3/1914 | Weis | 112/314 |
| 1,467,072 | 9/1923 | Rohr | 112/313 |
| 1,536,578 | 5/1925 | Groebli | 112/324 |
| 2,771,848 | 11/1956 | Knaus et al. | 112/313 |
| 3,055,325 | 9/1962 | Adler | 112/308 X |
| 4,226,199 | 10/1980 | Adams | 112/308 |
| 4,404,509 | 9/1983 | Hartwig | 112/121.12 X |
| 4,423,690 | 1/1984 | Willenbacher et al. | 112/308 |
| 4,633,796 | 1/1987 | Hoffman-Glewe et al. | 112/314 |
| 4,674,426 | 1/1987 | Kasuda et al. | 112/314 X |
| 4,691,654 | 9/1987 | Meier | 112/324 X |
| 4,744,319 | 5/1988 | Rohr | 112/308 X |

*Primary Examiner*—Werner H. Schroeder
*Assistant Examiner*—Paul C. Lewis
*Attorney, Agent, or Firm*—Morgan & Finnegan

[57] ABSTRACT

A feed dog drive having an adjustable feed direction for a sewing machine having, a needle plate, a presser foot, and a feed dog element. The drive has a device for carrying out a feeding and lifting motion of the feed dog element, a holder, and a device for rotatably mounting the feed dog element on the holder such that it can be turned is synchronism with stitch formation of the sewing machine.

12 Claims, 6 Drawing Sheets

FEED DOG DRIVE FOR SEWING MACHINES

This is a continuation of application Ser. No. 086,758 filed on Aug. 18, 1987, now abandoned.

BACKGROUND OF THE INVENTION

The invention relates to a feed dog drive having an adjustable feed direction for a sewing machine.

A feed dog drive having an adjustable feed direction is described, for example, in Italian Patent Specification No. 63 01 70. Although this feed dog drive allows the workpiece to be fed in a straight line between two needle holes in any direction and in continuous sequence, it is not suitable for exerting a rotary motion on the workpiece. Such a rotary motion is, however, necessary in order to execute, for example, a so-called safety seam, which is made by two adjacently disposed needles, along a curved edge of a workpiece. In Italian Patent Specification No. 63 01 70, two motions, which are at right angles to one another and whose magnitude and direction can be regulated, are superimposed on the feed dog carrier, so that the resultant motion can be attained in any direction required. If feed adjustment is constant, the resultant feed motion is in a straight line. Even if the feed direction of the feed dogs is constantly being changed, no rotary motion is exerted on the workpiece, but rather stepwise linear feeding takes place in different directions.

A further direction-controlled feed dog drive is described in German Auslegeschrift No. 1 485 403 corresponding to U.S. Pat. No. 3,116,705. In this feed dog drive, two feed dog elements, whose feed magnitudes are adjustable independently of one another, are disposed adjacent to one another. The feed dog element adjacent to an edge guide carries out a larger feed motion than the other feed dog element, and presses the workpiece against the edge guide. The varying feed motion of the feed dog elements causes the workpiece to pucker. The surface of delicate workpieces is damaged, as the feed dog element carrying out the larger feed motion compared with the other rubs against the workpiece.

SUMMARY OF THE INVENTION

A principal feature of the present invention is the provision of a feed dog device having an adjustable feed direction for a sewing machine.

The feed dog drive of the present invention comprises, a needle plate, a presser foot, and a feed dog element. The drive has means for carrying out a feeding and lifting motion of the feed dog element, and a holder.

A feature of the present invention is that the drive has means for rotatably mounting the feed dog element on the holder such that it can be turned in synchronism with stitch formation of the sewing machine.

Another feature of the invention is that a workpiece may be fed by the drive as a direction-controlled curved manner without being puckered and without any damage to its surface.

Yet another feature of the invention is that as a result of the direction-controlled pivoting or swinging of the feed dog element in synchronism with stitch formation in the feed plane, the workpiece can be fed along a precise curve without being damaged or puckered.

Another feature of the invention is that the swinging motion can be introduced directly through moving sewing machine driving parts.

Still another feature of the invention is that the swinging motion of the feed dog element may be altered by an adjusting device controlled by a control command device.

Further features will become more fully apparent in the following description of the embodiments of this invention and from the appended claims.

DESCRIPTION OF THE PREFERRED EMBODIMENTS

Figure 1:
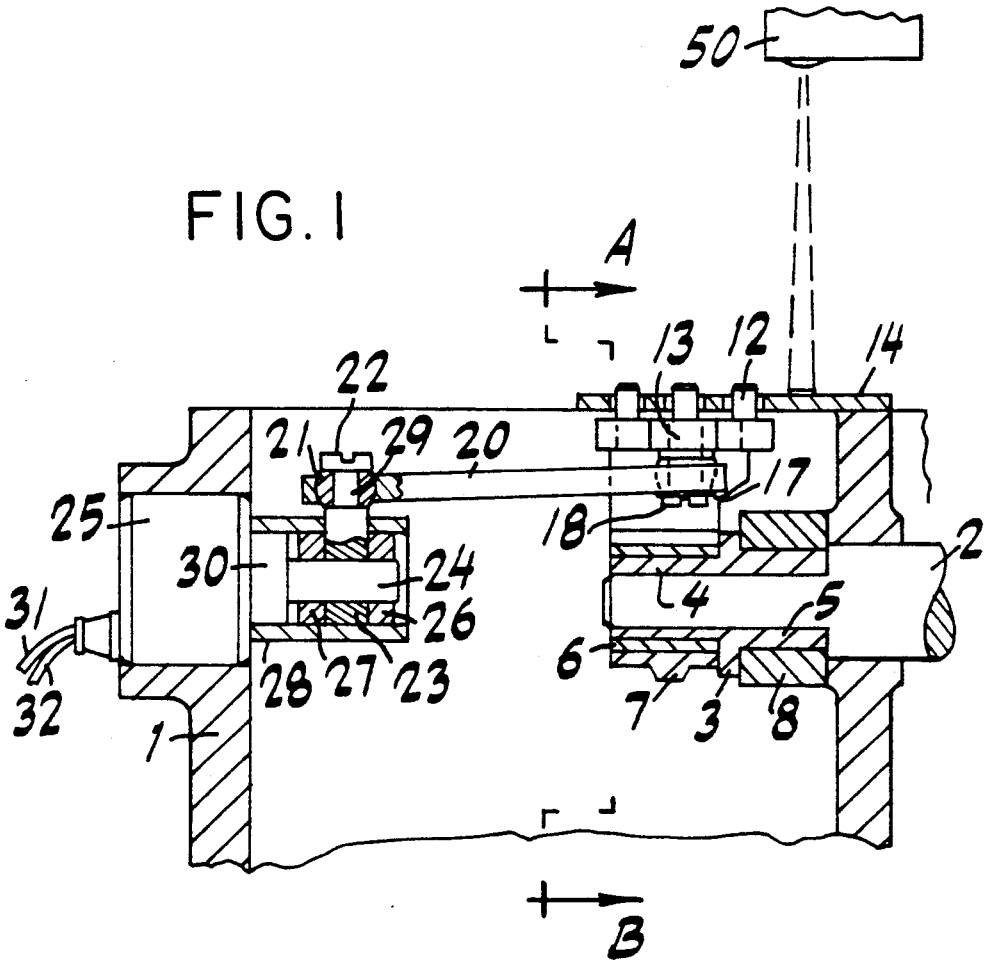
FIG. 1 is a front sectional view of a feed dog drive taken substantially as indicated along the line I—I of FIG. 2.

A feed dog drive is disposed in a sewing machine housing 1 and is driven by a shaft 2. An eccentric element 3 is disposed on the shaft 2 and has a lifting eccentric 4 and a pushing eccentric 5. The lifting eccentric 4 is enclosed by a slide block 6 which is mounted in a feed dog carrier 7. The pushing eccentric 5 is enclosed by a connecting rod 8.

On the feed dog carrier 7 there is a rotary guide spigot 10 on which the feed dog element 12 is pivotally mounted by means of a hollow stud 11. The dogs of the feed dog element 12 project through a needle plate 14 which is secured to the sewing machine housing 1 by a screw 15 and a screw 16. The needle plato 14 contains a needle hole 19.

Figure 8:
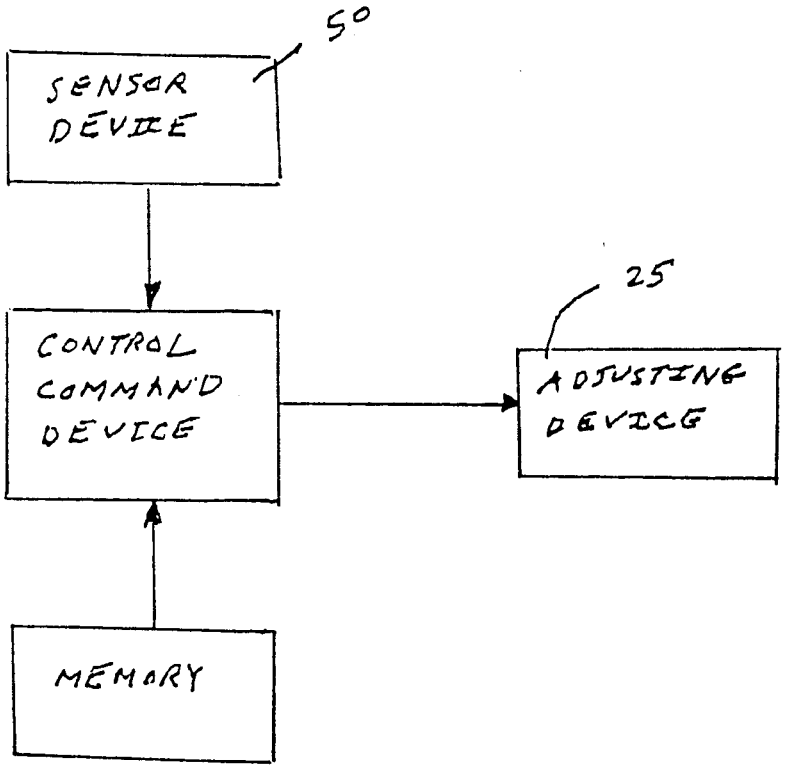
FIG. 8 is a diagrammatic view of a control command device of the invention.

A hollow sphere 17 is fastened by a screw 18 to an eye 13 of the feed dog element 12. One end of a connecting rod 20 encloses the hollow sphere 17 and the other end encloses a hollow sphere 21 which is secured by a screw 22 to an adjustable pivot point 29 of a split lever 23. The lever 23 is seated on a swivel shaft 24 which protrudes from an adjusting device 25. The swivel shaft 24 is mounted in two bushes 26 and 27, which are in turn disposed in a slotted sleeve 28. The sleeve 28 is seated on a spigot 30 of the adjusting device 25. As shown in FIG. 8, two leads 31 and 32 connect the adjusting device 25 to a control command device which is programmed by a memory for a predetermined seam pattern. The control command device includes a sensor device 50 which senses one edge of the workpiece.

The connecting rod 8 is articulated by a flange bolt 33, a washer 34 and a nut 35 to a frame 36. The frame 36 contains a slotted hole 37 through which the flange bolt 33 projects. The size of the feed motion of the feed dog element 12 is altered by altering the position of the flange bolt 33 in the slotted hole 37. A shaft 38, which is fixed to the housing, articulates the frame 36 to the sewing machine housing 1. The feed dog carrier 7 is articulated to the free end of the frame 36 by means of a hollow shaft 40.

The feed dog 12 lies opposite a presser foot 44 which is connected to a boss 45, with the feed dog element being movable against the presser foot. The boss 45 is secured by a screw 46 to a presser rod 47 which is mounted in the sewing machine housing 1 so as to be resiliently biased downwardly. The tip of a sewing needle 48 points towards the presser foot 44 and tho needle plate 14.

By rotating the shaft 2 in a clockwise direction (FIG. 3), a lifting motion is transmitted to the feed dog 12 by way of the lifting eccentric 4, slide block 6 and feed dog carrier 7. A longitudinal motion in the direction of feed is super-imposed on this lifting motion by way of the pushing eccentric 5, the connecting rod 8, the frame 36 and the feed dog carrier 7.

In place of the eccentric drive of the feed dog 12 shown in the drawings, the feed dog may by driven by way of a linkage (not shown in the drawings).

Figure 2:
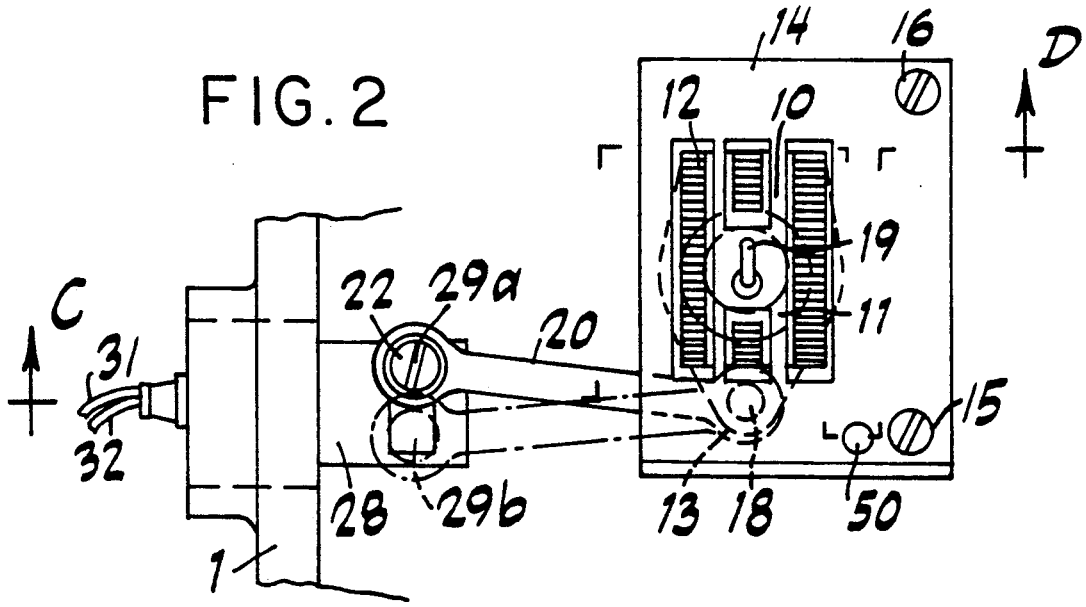
FIG. 2 is a plan view of the feed dog drive.

Since the feed dog element 12 is rotatably mounted on the rotary guide spigot 10 by way of the hollow stud 11 and is connected by way of the connecting rod 20 to the adjustable pivot point 29, the dogs on the element 12 perform a swinging motion above the surface of the needle plate in an anti-clockwise direction when in the pivot point position 29*a* shown in FIG. 2. The dogs on the element 12 swing back in the opposite direction when they are below the surface of the needle plate.

In the pivot point position 29*b* shown by the dotted line, the dogs on the feed dog element 12 are made to perform a swinging motion above the surface of the needle plate in a clockwise direction.

In a middle position between the two pivot point positions 29*a* and 29*b*, the feed dog 12 undergoes only a minimum swing or pivot deflection which corresponds approximately to the height of arc of a circular arc of the connecting rod about the middle position of the pivot point 29, that is, the pivoting motion is virtually ineffective and the feed motion of the workpiece is in a straight line.

By altering the positions of the pivot point 29, it is possible to influence the deflection transverse to the direction of sewing. The workpiece can thus be moved in an arc to the left or to the right as well as in a straight line in the direction of feed.

Figure 3:
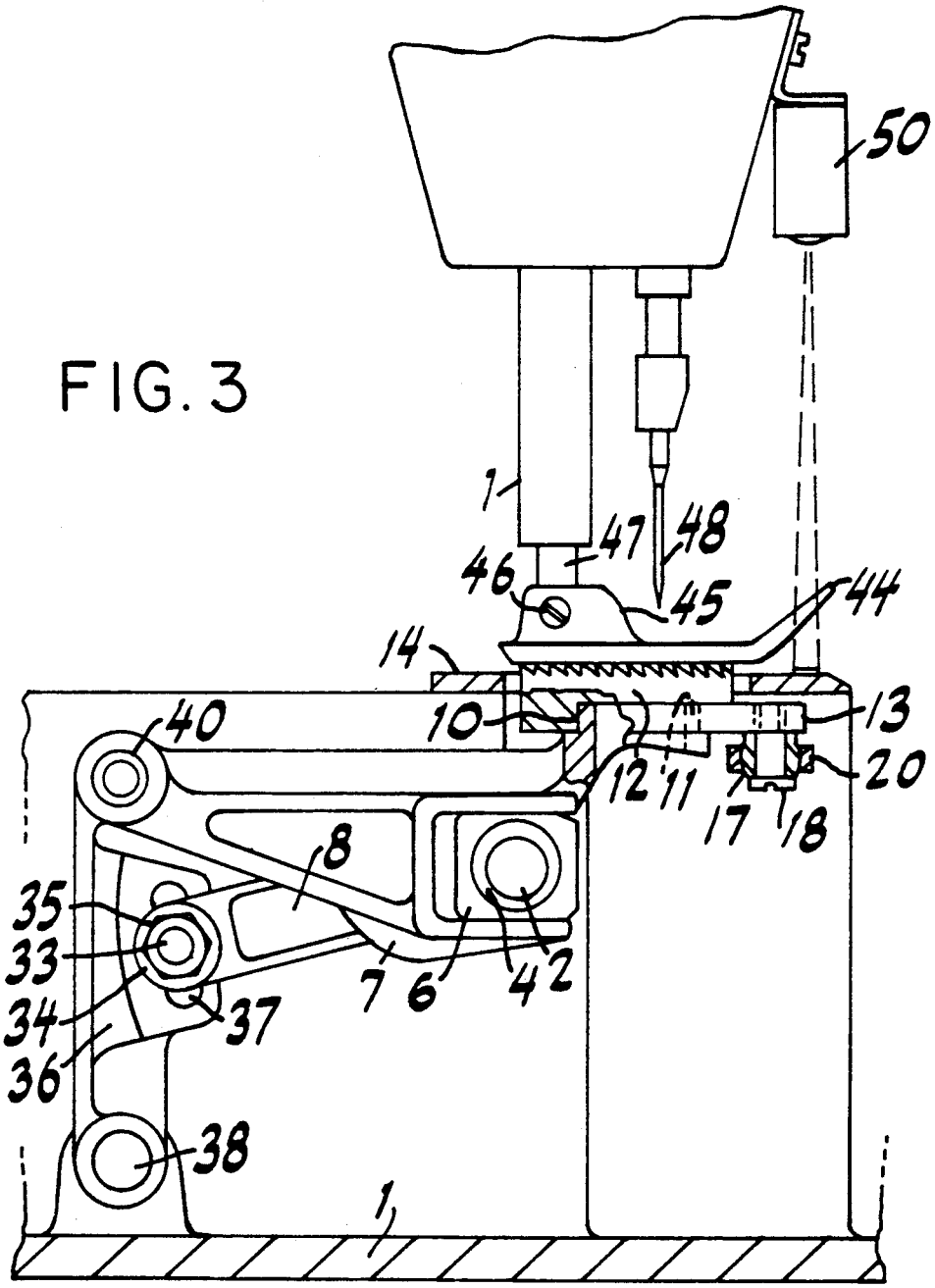
FIG. 3 is a sectional view taken subtantially as indicated along the line III—III of FIG. 1.

FIGS. 1, 2 and 3 show a feed dog drive in which the pivoting or swinging motion of the feed dog element is derived from the feed motion of such element. This permits a simply constructed swinging drive. A short stitch length produces a small swinging motion of the feed dog element.

Figure 4:
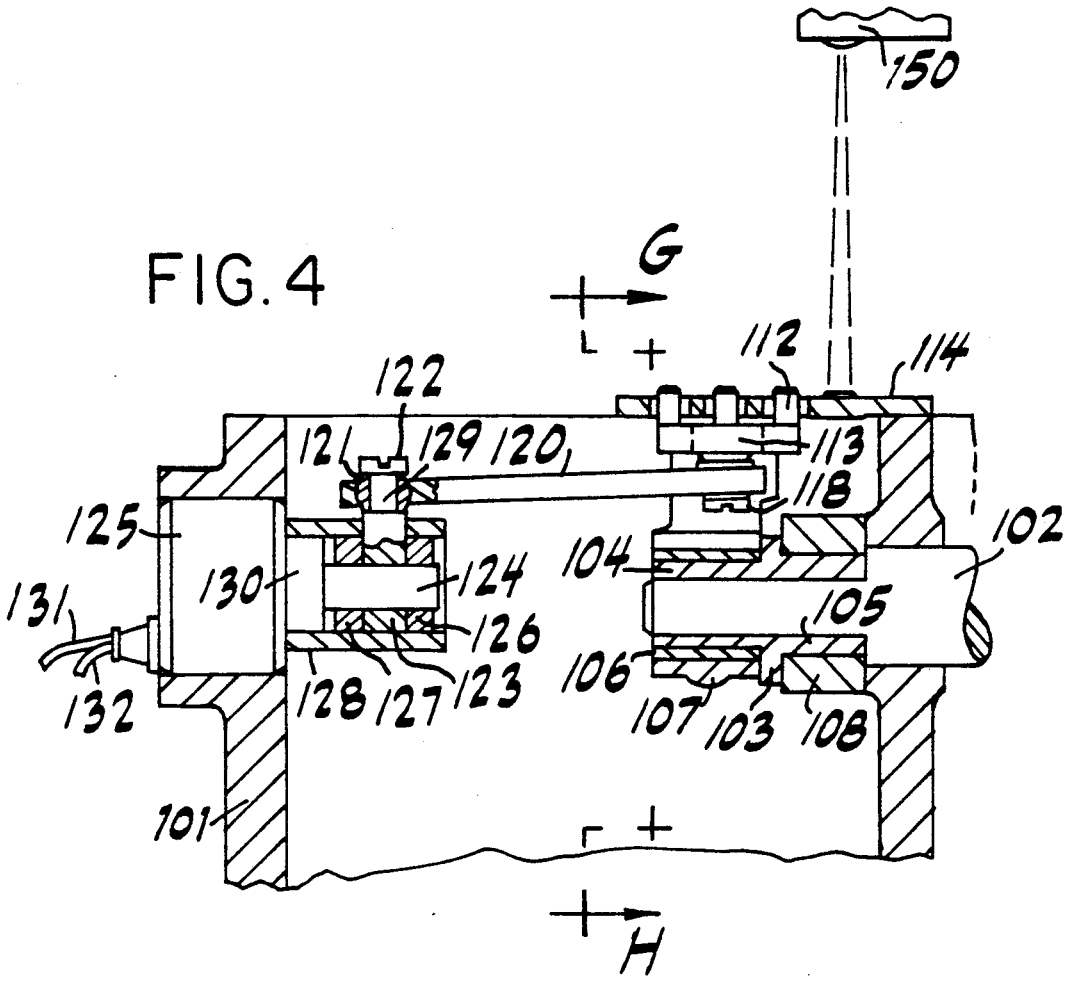
FIG. 4 is a sectional view of another embodiment of a feed dog drive taken substantially as indicated along the line V—V of FIG. 5.
Figure 5:
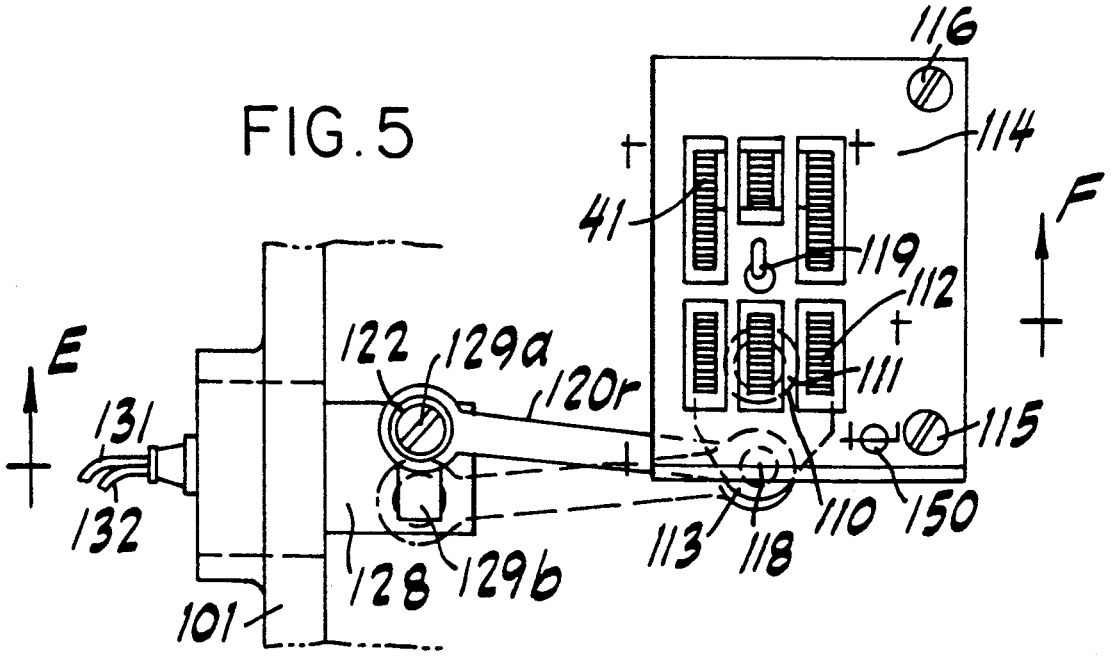
FIG. 5 is a plan view of the feed dog drive of FIG. 4.
Figure 6:
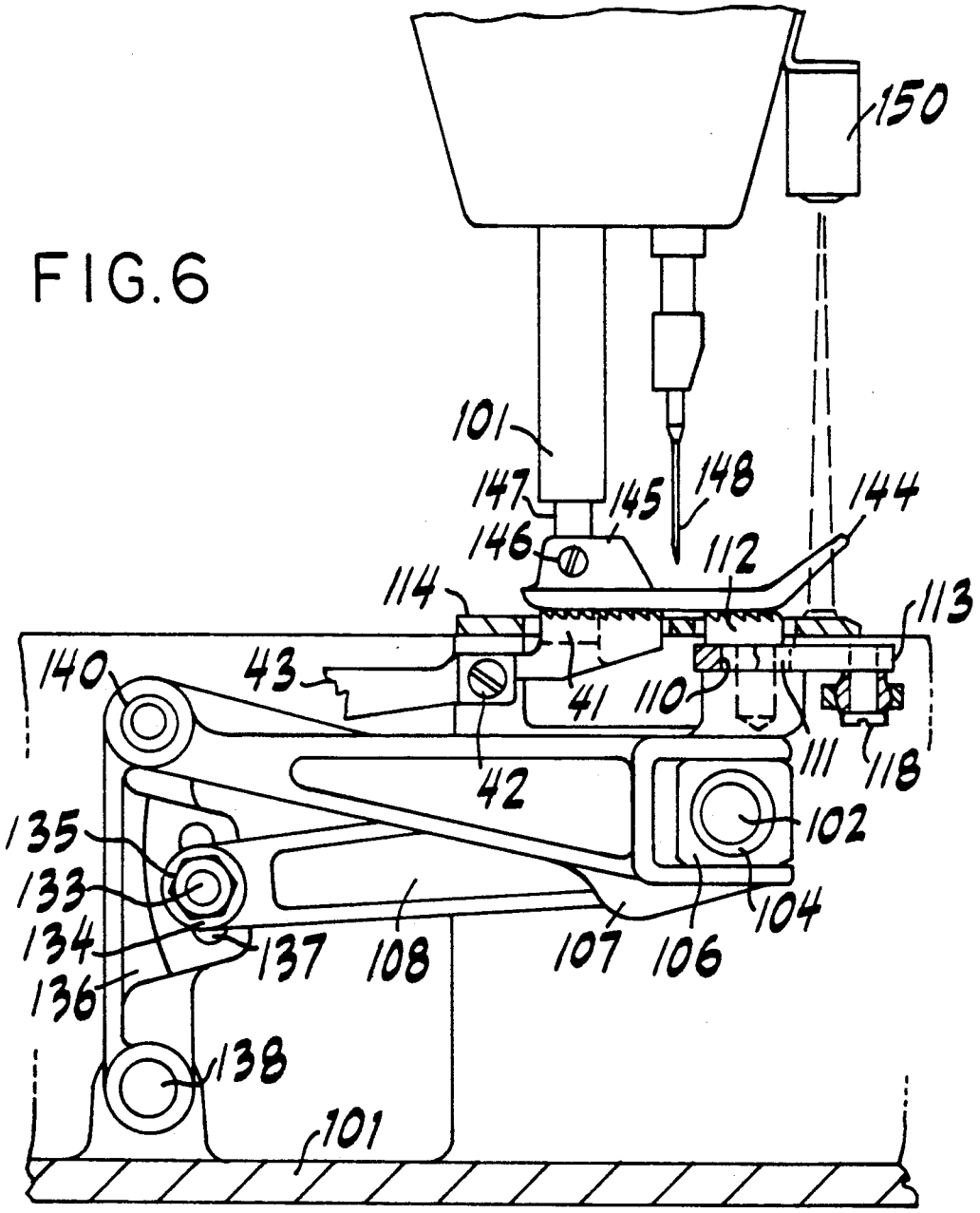
FIG. 6 is a sectional view taken substantially as indicate along the line VI—VI of FIG. 4.
Figure 7:
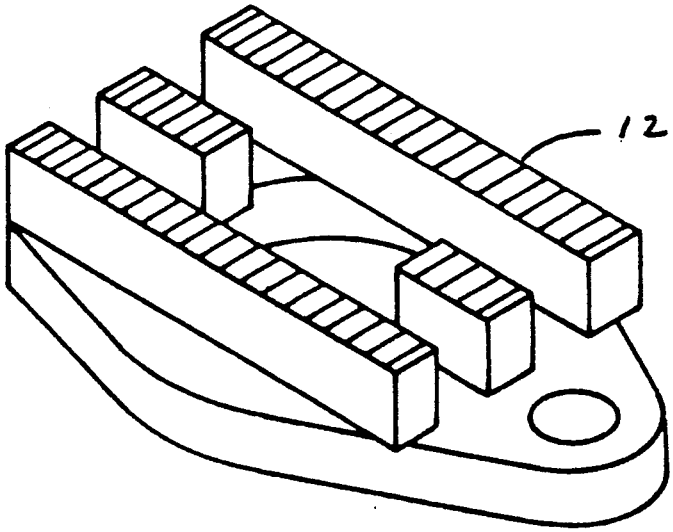
FIG. 7 is a perspective view on an enlarged scale of a feed dog element.

In FIGS. 4, 5 and 6, a direction-controllable feed dog drive is associated with a further feed dog drive and forms a so-called differential feed mechanism which, in contrast to conventional differential feed mechanisms, exerts an additional swinging motion on the workpiece. Those parts which are the same as in FIG. 1, 2 and 3 have been given the same numerals, but increased by 100. The second feed dog drive is represented by a feed dog clement 41 which is secured by a screw 42 to a feed dog carrier 43. The feeding and lifting drive (not shown) of this feed dog element 41 takes place in a known manner. The feed dog 41 is rotatably mounted in the feed drive mechanism so as to provide for the swinging drive.

The foregoing detailed description is given for clearness of understanding only, and no unnecessary limitations should be understood therefrom, as modifications will be obvious to those skilled in the art.

What is claimed is:

1. A feed dog drive having an adjustable feed direction for a sewing machine, having at least one feed dog element for carrying out a feeding and lifting motion, a needle plate and a presser foot, said feed dog element being rotatably mounted on a holder so that it can be turned in synchronism with stitch formation, in which the feed dog element is movable against the presser foot, said feed dog element performing a swinging motion being superimposed on the feed and lifting motion of the feed dog element, resulting in a resultant motion of the feed dog element, in which the swinging motion of the feed dog element is controlled by a control command device, and in which the control command device comprises a sensor device which senses one edge of the workpiece.

2. A feed dog drive as claimed in claim 1, in which the feed dog can be swung in opposite directions above and below the surface of the needle plate.

3. A feed dog drive as claimed in claim 1, in which the magnitude of the swinging motion of the feed dog element is adjustable by an adjusting device in a drive connection to the feed dog element.

4. A feed dog drive as claimed in claim 1, in which the holder is a feed dog carrier which has a rotary guide in which at least one feed dog element is pivotally mounted.

5. A feed dog drive as claimed in claim 1, in which the feed dog element is connected by way of a connecting rod to a pivot point.

6. A feed dog drive as claimed in claim 5, in which the pivot point at one end of the connecting rod can be moved by an adjusting device from a first end position, through a middle position into a second end position.

7. The feed dog drive of claim 1, wherein the control command device contains a memory which is programmed for a predetermined seam pattern.

8. A feed dog drive having an adjustable feed direction for a sewing machine, comprising:

a needle plate;

a presser foot;

a first feed dog element;

means for carrying out a feeding and lifting motion of the first feed dog element;

a holder; and means for rotatably mounting the first feed dog element on the holder such that it can be turned in synchronism with stitch formation of the sewing machine, wherein the holder comprises a feed dog carrier having a rotary guide in which the first feed dog element is pivotally mounted, including a control command device for controlling the pivoting motion of the first feed dog element, wherein the control command device includes a memory which is programmed for a predetermined seam pattern, including a second feed dog element associated in the direction of feed with the first feed dog element, and including means for rotatably mounting the second feed dog element and swinging the second feed dog element in the plane of sewing in synchronism with stitch formation.

9. The first feed dog drive of claim 8 wherein the feed dog element is connected by way of a connecting rod to a pivot point.

10. The feed dog drive of claim 9 including an adjusting device for moving the pivot point at one end of the connecting rod from a first end position through a middle position into a second end position.

11. A feed dog drive having an adjustable feed direction for a sewing machine, comprising:

a needle plate;

a presser foot;

a feed dog element;

means for carrying out a feeding and lifting motion of the feed dog element;

a holder; and means for pivotally mounting the feed dog element on the holder such that it can be turned in synchronism with stitch formation of the sewing machine, wherein the holder comprises a feed dog carrier having a rotary guide in which said feed dog element is pivotally mounted, including a control command device for controlling the pivoting motion of the feed dog element causing a resultant motion of the feed dog element, and wherein the control command device includes a sensor device which senses one edge of the workpiece.

12. A feed dog drive having an adjustable feed direction for a sewing machine, having at least one feed dog element for carrying out a feeding and lifting motion, a needle plate and a presser foot, said feed dog element being rotatably mounted on a holder so that it can be turned in synchronism with stitch formation, in which the feed dog element is movable against the presser foot, said feed dog element performing a swinging motion being superimposed on the feed and lifting motion of the feed dog element resulting in a resultant motion of the feed dog element, in which a further feed dog element is associated in the direction of feed with the said feed dog element, which is rotatably mounted and which can be swung in the plane of sewing in synchronism with stitch formation.

* * * * *